US010118794B2

(12) United States Patent
Bostian

(10) Patent No.: US 10,118,794 B2
(45) Date of Patent: Nov. 6, 2018

(54) HEADER COVER

(71) Applicant: Myron Bostian, Rockwell, NC (US)

(72) Inventor: Myron Bostian, Rockwell, NC (US)

(73) Assignee: SUPPLYONE, Rockwell, NC (US)

( * ) Notice: Subject to any disclaimer, the term of this patent is extended or adjusted under 35 U.S.C. 154(b) by 0 days.

(21) Appl. No.: 15/695,869

(22) Filed: Sep. 5, 2017

(65) Prior Publication Data

US 2018/0065826 A1 Mar. 8, 2018

Related U.S. Application Data

(60) Provisional application No. 62/383,222, filed on Sep. 2, 2016.

(51) Int. Cl.
*B65H 75/18* (2006.01)
*B65H 75/28* (2006.01)
*B65D 85/671* (2006.01)

(52) U.S. Cl.
CPC ..... *B65H 75/185* (2013.01); *B65D 85/671* (2013.01); *B65H 75/285* (2013.01); *B65H 2701/131* (2013.01); *B65H 2701/1315* (2013.01); *B65H 2701/50* (2013.01)

(58) Field of Classification Search
CPC ..... B65H 75/185; B65H 75/285; B65H 2701/131; B65H 2701/1315; B65H 2701/50; B65D 85/671
See application file for complete search history.

(56) References Cited

U.S. PATENT DOCUMENTS 1,377,154 A * 5/1921 Flynn ..... G03B 17/30 206/415
2,137,745 A * 11/1938 White ..... B65D 85/671 206/402
4,516,892 A * 5/1985 Curro, Jr. ..... B65H 75/185 206/413
4,995,512 A * 2/1991 Liebel ..... B65D 59/00 206/396
5,803,255 A * 9/1998 Peeters ..... G03C 3/00 206/398
5,961,063 A * 10/1999 Parry ..... B65H 16/005 242/422.4
9,415,971 B2 * 8/2016 Duchanois ..... B65H 75/185
2004/0245282 A1 * 12/2004 Yu Chen ..... B65B 67/085 222/33

(Continued)

*Primary Examiner* — Michael A Riegelman

(57) ABSTRACT

A header cover encloses an end of an unwoven material cylinder to protect the unwoven material from damage or debris during storage or transportation. Unwoven material cylinders are commonly used to produce products such as clean suits, baby diapers, absorbent material, etc. The header cover includes a cover disc, a plurality of lateral-interfacing flaps, and a tethering ring. The cover disc and the plurality of lateral interfacing flaps encapsulate an end of the unwoven material cylinder. The plurality of lateral-interfacing flaps is perimetrically and foldably connected to the cover disc to allow the header cover to fold over an edge of the unwoven material cylinder. The tethering ring is adjacently connected to each lateral-interfacing flap of the plurality of lateral-interfacing flaps, such that as one lateral-interfacing flap is folded, every lateral interfacing flap is folded in the same direction.

15 Claims, 3 Drawing Sheets

(56) References Cited

U.S. PATENT DOCUMENTS

| | | | | |
|---|---|---|---|---|
| 2010/0213304 | A1* | 8/2010 | McCall | A01K 97/06<br>242/579 |
| 2013/0270138 | A1* | 10/2013 | Weber | B65H 75/185<br>206/414 |
| 2016/0001906 | A1* | 1/2016 | Weissbrod | B65H 49/38<br>53/116 |
| 2016/0332842 | A1* | 11/2016 | Hanson | B65H 75/406 |
| 2017/0158420 | A1* | 6/2017 | Chiu | B65D 85/671 |
| 2017/0211234 | A1* | 7/2017 | Baer | A47K 10/3818 |

* cited by examiner

HEADER COVER

The current application claims a priority to the U.S. Provisional Patent application Ser. No. 62/383,222 filed on Sep. 2, 2016. The current application is filed on the next business day, which is Sep. 5, 2017, while Sep. 2, 2017 was on a weekend and Sep. 4, 2017 was on a national holiday (Labor Day).

FIELD OF THE INVENTION

The present invention relates generally to a covering apparatus. More specifically, the present invention relates to a cover that protect the flat faces, corners, and sidewalls of large cylindrical rolls of unwoven material.

BACKGROUND OF THE INVENTION

Physical covers are used to protect many objects from sources of damage, debris, and other environmental effects. These covers are made for all types of objects that include but are not limited to phones, car seats, circuitry, manufacturing material, etc. The covers can be made from a plurality of different materials including, but not limited to, metals, polymers, and composites. Besides providing protection, covers are also used aesthetically to make a product more aesthetically appealing.

In the world of manufacturing, large cylindrical rolls of unwoven material are used to produce products such as clean suits, baby diapers, absorbent material, etc. Simple covers exist that protect part of the flat faces of these rolls. These covers are generally made out of corrugated material (cardboard), cylindrically shaped, and very thin. These covers vary in size, but are generally too small to fit the entire flat face of the unwoven rolls the cover is meant to protect. Further, these covers do not protect the corners or sidewalls, nor are they adjustable to fit various unwoven roll sizes.

Therefore, an objective of the present invention is to introduce the header cover, which is a corrugated cover or "header" that protects the open faces, corners, and terminal sidewalls of unwoven material cylinders. The present invention allows the corrugated product to encapsulate the ends for the cylinder of unwoven material for protection. The present invention is easy to use and can be fitted to a variety of different roll sizes.

DETAIL DESCRIPTIONS OF THE INVENTION

All illustrations of the drawings are for the purpose of describing selected versions of the present invention and are not intended to limit the scope of the present invention.

The present invention is a header cover. The present invention is an apparatus used to encapsulate an end of an unwoven material cylinder for protection of the unwoven material. Unwoven material cylinders are commonly used to produce products, such as clean suits, baby diapers, or absorbent materials. As these products are intended to have a low level of environmental pollutants or be used an area with low levels of environmental pollutants, the present invention protects the unwoven material cylinder from these environmental pollutants for storage or transportation. The present invention is secured to the lateral portion of the unwoven material cylinder and covers the end of the unwoven material cylinder.

Figure 1:
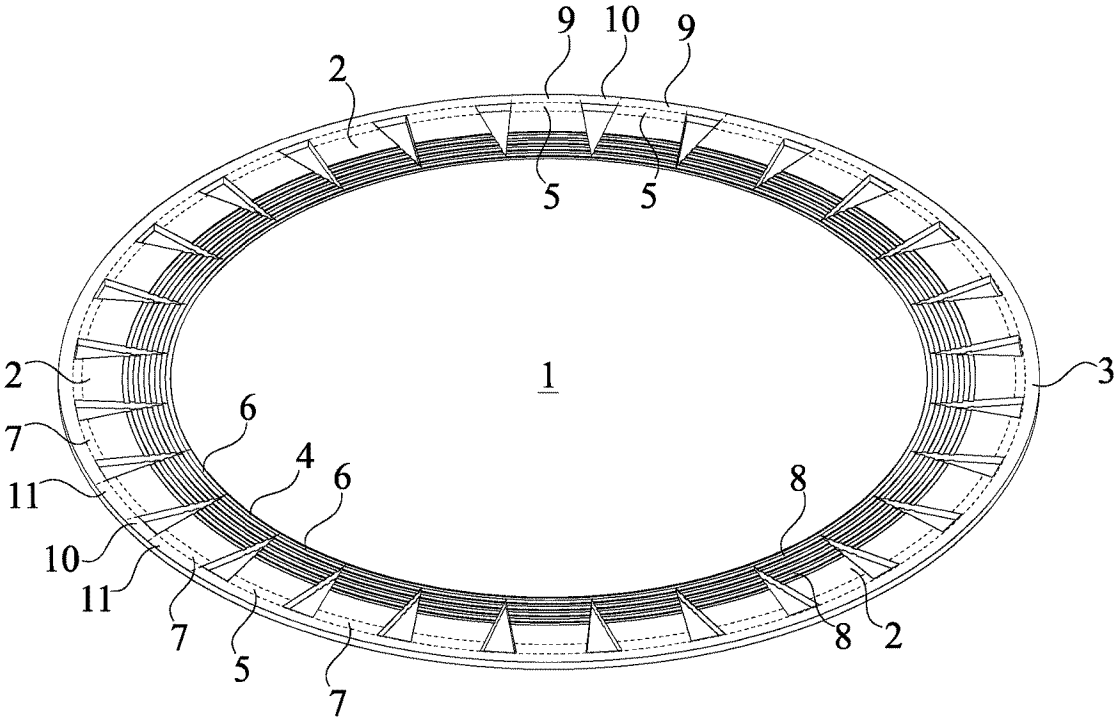
FIG. 1 is a perspective view of the present invention.
Figure 2:
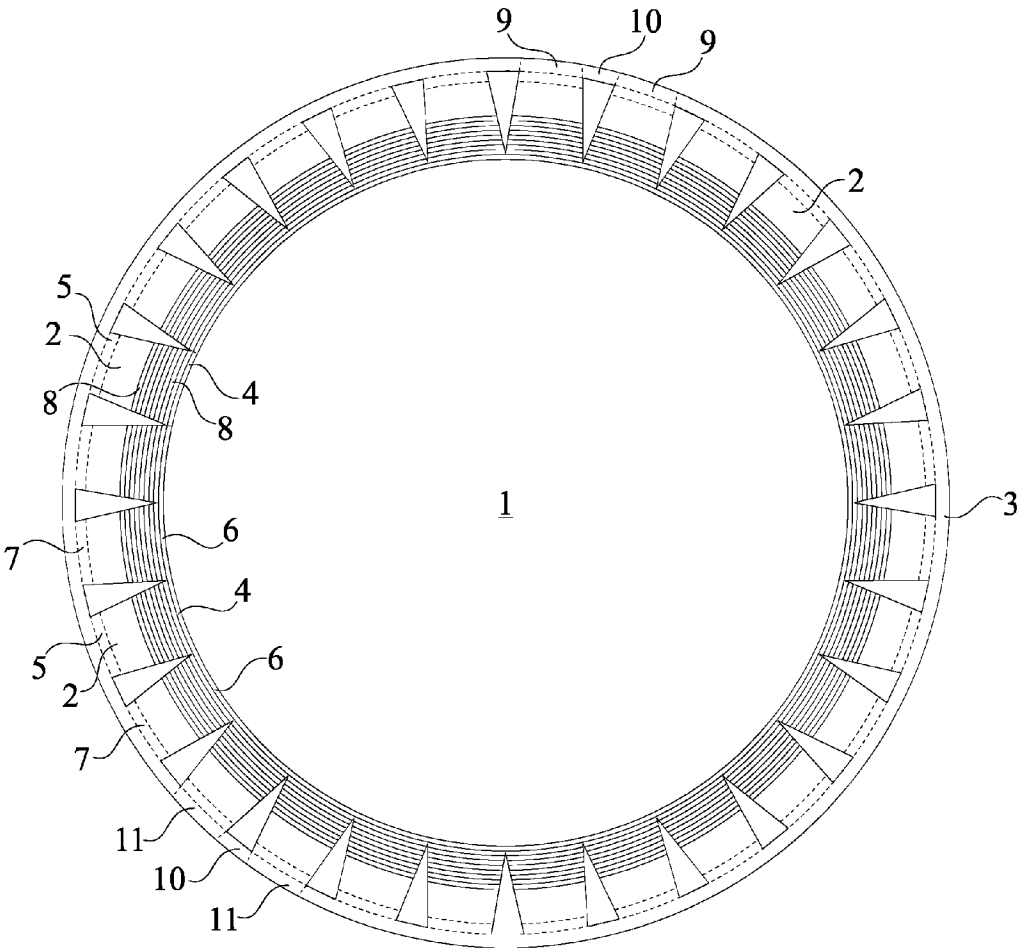
FIG. 2 is a front view of the present invention.

In accordance to FIG. 1 and FIG. 2, the present invention comprises a cover disc 1, a plurality of lateral-interfacing flaps 2, and a tethering ring 3. The cover disc 1 protects the end of the unwoven material cylinder from damage. The plurality of lateral-interfacing flaps 2 wraps around an edge of the unwoven material cylinder, in order to protect the edge from damage and debris during transportation. The plurality of lateral-interfacing flaps 2 is perimetrically connected about the cover disc 1. Each lateral-interfacing flap is preferably foldably connected to the cover disc 1 to allow the present invention to be folded over the edge of the unwoven material cylinder to protect the unwoven material cylinder.

The tethering ring 3 links each lateral-interfacing flap such that if a single flap of the plurality of lateral-interfacing flaps 2 is pivoted inward towards a center of the cover disk 1, each lateral-interfacing flap pivots in the same direction. As such, the tethering ring 3 is adjacently connected to each lateral-interfacing flap of the plurality of lateral-interfacing flaps 2. Furthermore, the tethering ring 3 is oppositely positioned to the cover base, along each lateral interfacing-flap.

More specifically, each lateral-interfacing flap comprises a disc end 4 and a ring end 5. The disc end 4 is adjacently connected to the cover disc 1, as shown in FIG. 1 and FIG. 2. Each disc end 4 is adjacently positioned between a pair of adjacent disc ends 6. The ring end 5 is adjacently connected to the tethering ring 3. Each ring end 5 is offset from a pair of adjacent ring ends 7. Therefore, each lateral-interfacing flap and the tethering ring 3 delineate a triangular slit. The triangular slit allows each lateral-interfacing flap to be positioned adjacent to another as the present invention is positioned around the unwoven material cylinder.

Further in accordance to the preferred embodiment of the present invention, each lateral-interfacing flap comprises a plurality of folding creases 8, detailed in FIG. 1 and FIG. 2. The plurality of folding creases 8 allows the present invention to accommodate a plurality of unwoven material cylinders with differing diameters. The plurality of folding creases 8 is positioned between the disc end 4 and the ring end 5. Each folding crease is radially offset from each other. This configuration allows the plurality of lateral-interfacing flaps 2 to fold over unwoven material cylinders with diameters larger than the cover disc 1.

Figure 3:
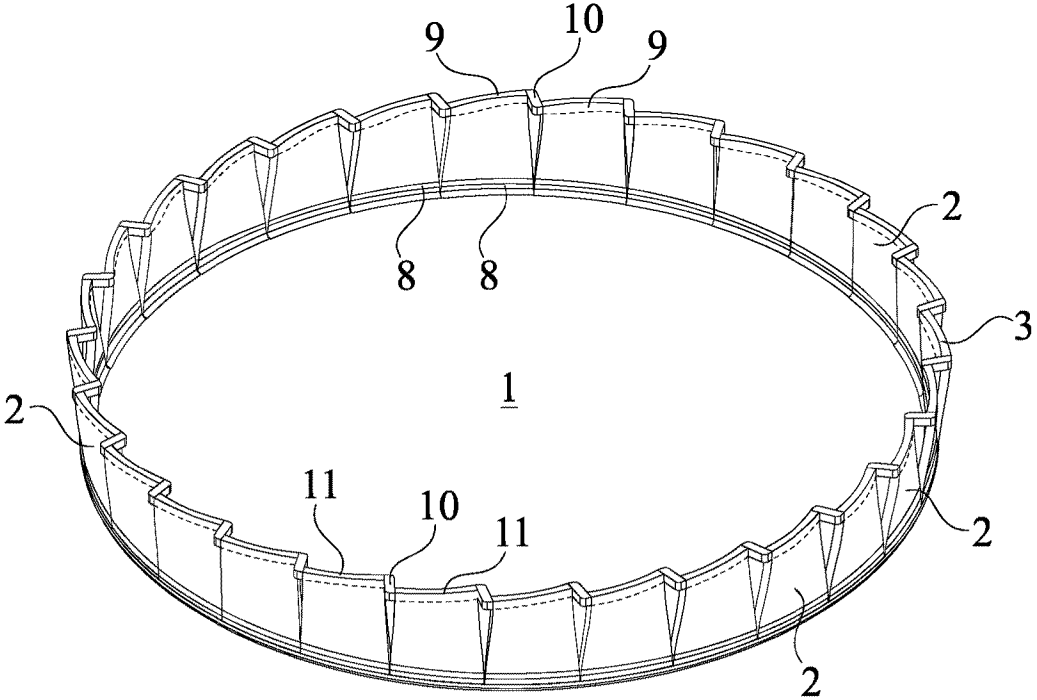
FIG. 3 is a perspective view of the present invention, wherein each lateral-interfacing flap of the plurality of lateral-interfacing flaps is folded along a folding crease of the plurality of folding creases.

The tethering ring 3 comprises a plurality of flap portions 9 and a plurality of linking portions 10. Each of the plurality of flap portions 9 is adjacently connected to a corresponding ring end 5. Each of the linking portions is foldably connected between a pair of flap portions 11 of the plurality of flap portions 9. This configuration allows the tethering ring 3 to deform as the plurality of lateral-interfacing flaps 2 is folded around the unwoven material cylinder, in accordance to FIG. 3.

The cover disc 1, the plurality of lateral-interfacing flaps 2, and the tethering ring 3 are preferred to be corrugated. The corrugated nature of the cover disc 1, the plurality of lateral-interfacing flaps 2, and the tethering ring 3 allows for the flexibility and durability of the present invention.

In accordance to the preferred embodiment, the cover disc 1, the plurality of lateral-interfacing flaps 2, and the tethering ring 3 is approximately a half inch in thickness to sufficiently protect the unwoven material cylinder from damage. The cover disc 1 is preferred to be approximately thirty-six inches in diameter to lay flat across the diameter for an unwoven material cylinder. The tethering ring 3 is preferred to have an outer diameter of forty-six inches from the center of the cover disc 1 in order to allow the present invention to accommodate a plurality of diameters of unwoven material cylinders.

For an alternate embodiment of the present invention, the present invention comprises a protective coating. The protective coating is a film to further protect the present invention and the unwoven material cylinder from additional environmental damage, such as a waterproofing film for example. The protective coating is superimposed onto the cover disc 1, the plurality of lateral-interfacing flaps 2, and the tethering ring 3 in order to encapsulate the present invention with the protective coating, and therefore the protective coating protects the unwoven material cylinder.

Although the invention has been explained in relation to its preferred embodiment, it is to be understood that many other possible modifications and variations can be made without departing from the spirit and scope of the invention as hereinafter claimed.

What is claimed is:

1. A header cover comprises:
a cover disc;
a plurality of lateral-interfacing flaps;
a tethering ring;
the plurality of lateral-interfacing flaps being perimetrically connected about the cover disc;
the tethering ring being adjacently connected to each lateral-interfacing flap of the plurality of lateral interfacing flaps; and
the tethering ring being oppositely positioned to the cover base, along each lateral interfacing-flap.

2. The header cover, as claimed in claim 1, comprises:
each lateral-interfacing flap being foldably connected to the cover disc.

3. The header cover, as claimed in claim 1, comprises:
each lateral-interfacing flap comprises a disc end and a ring end;
the disc end being adjacently connected to the cover disc; and
the ring end being adjacently connected to the tethering ring.

4. The header cover, as claimed in claim 3, comprises:
each disc end being adjacently positioned between a pair of adjacent disc ends.

5. The header cover, as claimed in claim 3, comprises:
each ring end being offset from a pair of adjacent ring ends.

6. The header cover, as claimed in claim 3, comprises:
each lateral-interfacing flap comprises a plurality of folding creases;
the plurality of folding creases being positioned between the disc end and the ring end; and
each folding crease being radially offset from each other.

7. The header cover, as claimed in claim 3, comprises:
the tethering ring comprises a plurality of flap portions and a plurality of linking portions;
each flap portion being adjacently connected to a corresponding ring end; and
each linking portion being foldably connected between a pair of flap portions of the plurality of flap portions.

8. The header cover, as claimed in claim 1, wherein the cover disc, the plurality of lateral-interfacing flaps, and the tethering ring are corrugated.

9. A header cover comprises:
a cover disc;
a plurality of lateral-interfacing flaps;
a tethering ring;
each lateral-interfacing flap comprises a disc end and a ring end;
the plurality of lateral-interfacing flaps being perimetrically connected about the cover disc;
the tethering ring being adjacently connected to each lateral-interfacing flap of the plurality of lateral interfacing flaps;
the tethering ring being oppositely positioned to the cover base, along each lateral interfacing-flap;
the disc end being adjacently connected to the cover disc; and
the ring end being adjacently connected to the tethering ring.

10. The header cover, as claimed in claim 9, comprises:
each lateral-interfacing flap being foldably connected to the cover disc.

11. The header cover, as claimed in claim 9, comprises:
each disc end being adjacently positioned between a pair of adjacent disc ends.

12. The header cover, as claimed in claim 9, comprises:
each ring end being offset from a pair of adjacent ring ends.

13. The header cover, as claimed in claim 9, comprises:
each lateral-interfacing flap comprises a plurality of folding creases;
the plurality of folding creases being positioned between the disc end and the ring end; and
each folding crease being radially offset from each other.

14. The header cover, as claimed in claim 9, comprises:
the tethering ring comprises a plurality of flap portions and a plurality of linking portions;
each flap portion being adjacently connected to a corresponding ring end; and
each linking portion being foldably connected between a pair of flap portions of the plurality of flap portions.

15. The header cover, as claimed in claim 9, wherein the cover disc, the plurality of lateral-interfacing flaps, and the tethering ring are corrugated.

* * * * *